US009393615B2

(12) United States Patent
Evertz et al.

(10) Patent No.: US 9,393,615 B2
(45) Date of Patent: Jul. 19, 2016

(54) PROCESS AND DEVICE FOR PRODUCING A CAST STRIP WITH MATERIAL PROPERTIES WHICH ARE ADJUSTABLE OVER THE STRIP CROSS SECTION

(75) Inventors: Thomas Evertz, Peine (DE); Zacharias Georgeou, Wolfsburg (DE); Bianca Springub, Hannover (DE); Hellfried Eichholz, Ilsede (DE); Rune Schmidt-Jürgensen, Hannover (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 105 days.

(21) Appl. No.: 13/983,232

(22) PCT Filed: Jan. 6, 2012

(86) PCT No.: PCT/DE2012/000038

§ 371 (c)(1),
(2), (4) Date: Sep. 13, 2013

(87) PCT Pub. No.: WO2012/103862

PCT Pub. Date: Aug. 9, 2012

(65) Prior Publication Data

US 2014/0367066 A1 Dec. 18, 2014

(30) Foreign Application Priority Data

Feb. 2, 2011 (DE) ..... 10 2011 010 040

(51) Int. Cl.

| | |
|---|---|
| ***B22D 11/00*** | (2006.01) |
| ***B22D 11/06*** | (2006.01) |
| ***B22D 11/07*** | (2006.01) |

(52) U.S. Cl.

CPC ..... *B22D 11/07* (2013.01); *B22D 11/007* (2013.01); *B22D 11/0631* (2013.01)

(58) Field of Classification Search

CPC .. B22D 11/06; B22D 11/0631; B22D 11/007; B22D 11/07

USPC ..... 164/463, 479, 423, 429, 433, 482, 472, 164/473

See application file for complete search history.

(56) References Cited

U.S. PATENT DOCUMENTS 3,795,269 A * 3/1974 Leconte et al. ..... 164/472
4,027,716 A * 6/1977 Theobald et al. ..... 164/19

(Continued)

FOREIGN PATENT DOCUMENTS

DE 101 24 594 A1 12/2002
JP 59 220259 A 12/1984

(Continued)

OTHER PUBLICATIONS

International Search Report for PCT/DE2012/000038 issued on Oct. 8, 2012.

*Primary Examiner* — Kevin P Kerns
(74) *Attorney, Agent, or Firm* — Henry M. Feiereisen LLC

(57) ABSTRACT

A method for producing a cast strip from steel with properties that can be adjusted across a cross section and a length of the strip, includes applying a coating mass including a carrier liquid with additives contained therein to a side of a rotating cast band of a horizontal strip cast system, drying the coating mass for removing liquid components of the coating mass, applying a steel melt to the side of the rotating cast band via a melt container, wherein the dried coating mass is materially united with the applied steel melt; and allowing the steel melt to solidifiy to a pre-strip.

17 Claims, 1 Drawing Sheet

(56) References Cited

U.S. PATENT DOCUMENTS

| | | | | |
|---|---|---|---|---|
| 4,593,742 | A * | 6/1986 | Hazelett et al. | 164/415 |
| 5,636,681 | A * | 6/1997 | Sulzer et al. | 164/472 |
| 2009/0196785 | A1 | 8/2009 | Spitzer et al. | |
| 2009/0266503 | A1 | 10/2009 | Spitzer et al. | |
| 2010/0000634 | A1 | 1/2010 | Spehr et al. | |
| 2010/0000703 | A1 | 1/2010 | Spitzer et al. | |
| 2010/0059196 | A1 | 3/2010 | Spitzer et al. | |
| 2012/0093677 | A1 | 4/2012 | Spitzer et al. | |
| 2012/0121452 | A1 | 5/2012 | Spitzer et al. | |
| 2012/0132389 | A1 | 5/2012 | Eichholz et al. | |
| 2012/0138257 | A1 | 6/2012 | Eichholz et al. | |

FOREIGN PATENT DOCUMENTS

| | | | |
|---|---|---|---|
| JP | 63 303657 | A | 12/1988 |
| JP | 1 162546 | A | 6/1989 |
| JP | 1 249250 | A | 10/1989 |
| WO | WO 02/45885 | A1 | 6/2002 |

* cited by examiner

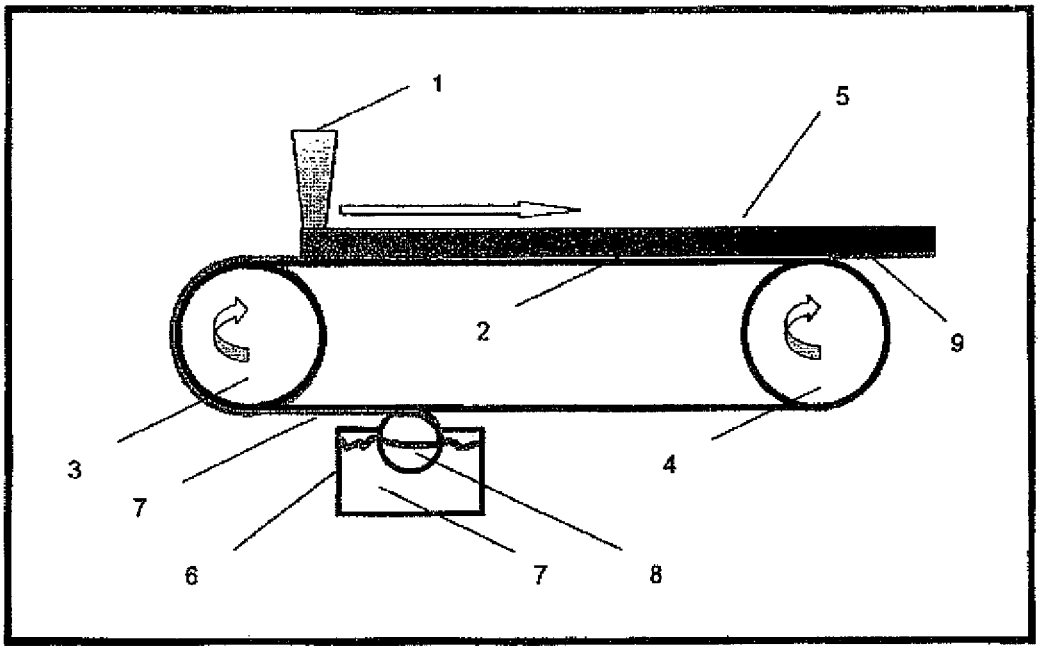
1
5
2
9
3
4
7
6
7
8

PROCESS AND DEVICE FOR PRODUCING A CAST STRIP WITH MATERIAL PROPERTIES WHICH ARE ADJUSTABLE OVER THE STRIP CROSS SECTION

CROSS-REFERENCES TO RELATED APPLICATIONS

This application is the U.S. National Stage of International Application No. PCT/DE2012/000038, filed Jan. 6, 2012, which designated the United States and has been published as International Publication No. WO 2012/103862 A2 and which claims the priority of German Patent Application, Serial No. 10 2011 010 040.7, filed Feb. 2, 2011, pursuant to 35 U.S.C. 119(a)-(d).

BACKGROUND OF THE INVENTION

The invention relates to a method for producing a cast strip with material properties the can be adjusted across the strip cross section and the strip length and a device for carrying out the method.

The hotly contested automobile market forces manufacturers to constantly seek solution for lowering the fleet consumption while at the same time maintaining a highest possible comfort and occupant protection. In this context, weight saving plays an important role, on the other hand also properties of the individual components that promote the passive safety of the passengers during high static and dynamic stresses during operation and in case of a crash.

The pre-material manufactures seek to account for these requirements by providing stress-optimized steel sheets and steel strips (for example Tailor welded or Tailored rolled strips), whose sheet thickness is optimized according to the expected stresses or consist of materials with different strengths.

Such steel sheets and steel strips have to meet relatively high standards regarding strength ductility, tenacity energy absorption, wear and their processability such as for example cold forming, welding and/or surface treatment.

Disadvantages of stress-optimized steel sheets in the welded sheet metal blanks are the laborious cutting and joining processes as well as sharp property gradients at material transition.

A method for producing a composite material from steel is known for example from DE 101 24 594 A1. Here, a ferritic core strip which is directly cast according to the two-roll method is cladded with an austenitic or high alloyed ferritic cladding strip.

In a comparable method according to WO 02/45885 A1 a re-oxidation preventing coating is applied on one or both sides during passage through the rolls.

Disadvantageous in this case is also the sharp jump of the properties of the composite material as a result of the cladding which makes the optimal adjustment of the properties across the strip width according to the respective requirement difficult. Further, the properties cannot be varied across the strip width.

A method for producing strips from lightweight steel by means of a horizontal strip casting system is for example known from the periodical Steel Research 74 (2003), No 11/12, page 724-731. In this method, melt is applied from an application system from a delivery container via a casting groove onto a circulating strip of a horizontal strip casting system. As a result of intensive cooling of the cast strip the applied melt solidifies to a pre strip with a thickness in the range between 6-20 mm. After the complete solidification the pre strip is subjected to a hot rolling process.

With this method, lightweight steel with high manganese or high aluminum content can be ideally produced which are difficult to produce by means of conventional methods such as the continuous casting.

In these lightweight steels a weight reduction which is advantageous for the automobile industry is achieved due to the high proportion of alloy components with a specific weight of far below the specific weight of iron (for example Mn, Si, Al), while at the same time retaining the previous construction method.

So far, it was not possible however to produce steel strips with these known strip casting methods which have material properties which are stress-optimized across the strip cross section and the strip length regarding deformation, crash or wear characteristics.

SUMMARY OF THE INVENTION

Object of the invention is to present a method for producing a strip made of steel by means of horizontal strip casting with which the demanded material properties can be variably adjusted across the strip cross section and the strip length. Further, a device for implementing the method is provided.

This object is solved based on the preamble in combination with the characterizing features of the independent method claim. Advantageous refinements are the subject matter of sub claims.

The method according to the invention is characterized in that prior to application of the melt onto the cast band a coating mass composed of a liquid or paste-like carrier mass with additives introduced therein is applied to the side of the cast band that comes into contact with the melt, dried prior to applying the melt and subsequently materially united with the applied melt.

The additives can be metallic or non-metallic elements, with which the material properties (such as mechanical, corrosion and wear properties) can be influenced in a targeted manner.

These can include a broad spectrum of metals for alloying up the basic material or metallic oxides/nitrides/borides which depending on the melt temperature precipitate on the surface of the forming steel strip or are introduced into the material by melting.

Important is that prior to applying the melt onto the cast band, not yet dried components of the coating mass that may be present are removed in order to avoid an eruptive evaporation during application of the melt and flaws in the solidifying cast strip resulting therefrom such as pores or cavities.

According to the invention, a drying unit is therefore provided which removes the liquid components from the coating mass prior to application of the melt so that only the additive of the coating mass remains on the surface of the cast band.

As an alternative it is also possible for the drying to use the residual heat of the cast band stemming from the previously applied melt. The coating of the cast band should therefore occur at a site at which the cast band still has a sufficient residual heat.

By melting the coating, the metallic elements that are added to the coating mass during the casting on of the melt onto the cast band, an intermixing of the liquid phases occurs so that the applied melt is alloyed up in the region of the intermixing.

Via an additional heating of the cast band by changing the thickness of the applied coating mass or of the casting speed, the heat exchange between melt and coating mass can be advantageously controlled so that the coating mass is melted completely or only partially, wherein in the latter case only the surface-proximate layer of the coating reacts with the base material via diffusion processes so that the steel strip that results from the cast strip after cooling has directly after the solidification a coating made of the alloy elements that were added to the coating mass. The specific material properties of the thus produced steel strip can be adjusted in the region of the alloying according to demands via the content of alloy elements.

Melting the coating mass only partially melted results in a further effect that influences the material properties. Due to the fact that the not melted portions of the coating mass function quasi as a separation layer between the melt and the casting band, the heat dissipation of the melt to the cast band and with this the solidification speed of the melt can be advantageously influenced via the thickness of this separation layer. In addition, the detachment of the strip can be improved by the separating function of the layer in the sense of a facing, for example as oxidation protection. This separation layer then remains as securely adhering layer on the generated steel strip.

In an advantageous refinement of the invention, the alloying proportion relative to the base material is variably adjusted during the strip casting by means of the different thickness of the applied coating mass so that by alloying up, a steel strip with different properties across the strip length is generated and in this way steel strips or steel strip sections with stress-optimized subsections can be produced. The coating thickness can for example be variably adjusted by grit blasting or stripping off the applied coating mass or by changing the viscosity.

In a further advantageous embodiment of the invention, a coating with respectively different alloy composition and/or different thickness is applied over the width of the cast strip so that corresponding different properties can also be adjusted across the width of the forming steel strip.

The coating mass is for example applied to the cast by way of a container which is filled with the coating mass and is arranged underneath the cast band and an applicator roll which is immersed in the container, and is rolled off onto the moving cast band. The thickness of the coating mass to be applied can be controlled via the pressing force and/or the rotational speed of the applicator roll. If necessary, the applicator roll can be configured to be separately driven by a motor.

According to the invention, the material properties can thus be correspondingly flexibly adjusted across the width and length of the forming steel strip, symmetrically or asymmetrically or according to the respective demands. Through the addition of corresponding alloy means an adjustment to the demanded strength tenacity corrosion or wear properties is thus possible over a wide range.

When adding oxides, nitrides or borides to the coating mass, the latter precipitate due to the higher melting point as steel on the surface of the forming steel strip and remain there as materially bonded, securely adhering layer that forms a separation layer between the cast band and the melt.

As a result of the precipitation of these additives on the forming steel strip, the surface properties with regard to for example corrosion wear, electrical or magnetic properties can be adjusted over wide ranges. Optionally, the properties can additionally be influenced via the thickness of the precipitated layer across the length and width of the cast strip.

Tests have shown that the presence of a separation layer between solidified steel melt and cast band leads to a more even heat dissipation and with this to a more even geometric shape across the width of the produced steel strip during lifting from the cast band.

This significantly simplifies the delivery to the downstream production systems because a prior straightening of the steel strip is thus not required. For this, use of boron nitride in the coating mass has proven advantageous.

A further advantage of the coating of the cast band is the significantly lower wear due to mechanical and thermal stress of the cast band, which allows a significant reduction of maintenance costs.

With the present invention it is possible for the first time to produce a steel strip that was cast with the horizontal continuous cast method as composite material with different adjustable property gradients in transverse and longitudinal direction of the strip and with this meet the demands according to site specific material properties with regard to deformation crash and wear characteristics.

The steel strip produced according to the invention can subsequently be further processed in a known manner into a hot or cold strip by rolling, optionally with application of a coating.

The method according to the invention is generally suited for the production of strips from the different metallic materials in particular also for a high alloyed lightweight steel with high Mn, Si and Al contents In summary, the following advantages result from the invention:

- Cost effective realization of combinations of different transverse and longitudinal strip properties,
- Strip properties can be continuously adjusted without abrupt jumps of properties,
- Use of regionally different alloy compositions due to adjustable degree of intermixing, for producing strength gradients or site specific deformation/crash properties.

BRIEF DESCRIPTION OF THE DRAWING

The method according to the invention is explained in more detail by way of a schematic representation shown in the FIGURE.

The FIGURE shows a side view of a horizontal strip casting system with a device according to the invention for application of a coating mass onto a cast band for influencing the material properties of the forming steel strip in transverse and longitudinal direction in a targeted manner.

DETAILED DESCRIPTION OF PREFERRED EMBODIMENTS

A melt container 1 can be seen in the FIGURE out of which liquid steel melt is applied onto a cast band 2 as cast strip which cast band rotates around a front deflection roller 3 and a rear deflection roller 4.

Located underneath the cast band 2 is the device according to the invention for application of the coating mass 7 onto the cast band 2. The device is includes a container 6 with a paste-like coating mass 7 contained therein and an applicator roll 8 that is immersed in the coating mass 7, which applicator roll 8 is in contact with the cast band 2. The applicator roll is driven by frictional engagement with the cast band 2 and in this way distributes the coating mass 7 evenly on the bottom side of the cast band 2. Not shown is the drying unit for complete drying of the coating mass prior to application of the melt onto the cast band.

By controlling the cooling speed of the melt on the cast band 2, the coating mass can either be completely melted and with this the steel melt be alloyed up, or a securely adhering coating forms on the steel strip.

By a here not shown cooling of the strip after application of the melt, the heat transition from the melt applied to the cast band 2 to the coating mass can be controlled, depending on the selection of additives in the coating mass, the thickness of the coating or the casting speed so that the casting band 5 or the forming steel strip is provided with a coating 9 whose thickness can be adjusted across the strip length.

Via here also not shown multiple application devices that are distributed over the width of the cast band 2, different compositions of coating masses 7 can be applied onto the cast band 2 and in this way different properties and property gradients of the steel strip achieved also across the width.

The invention claimed is:

1. A method for producing a cast strip from steel with properties that are adjusted across a cross section and a length of the strip, comprising:

applying a coating mass comprising a carrier liquid with additives contained therein to a side of a rotating cast band of a horizontal strip cast system;

drying the coating mass for removing liquid components of the coating mass;

applying a steel melt to said side of the rotating cast band via a melt container, wherein the dried coating mass is materially united with the applied steel melt;

melting the coating;

alloying the additives with the steel melt allowing the steel melt to solidify to a pre-strip; and adjusting material properties across the cross section and the length of the cast strip by varying a thickness of the applied coating mass.

2. The method of claim 1, further comprising subjecting the pre-strip to a hot rolling process.

3. The method of claim 1, wherein the carrier liquid contains metallic or non-metallic elements for targeted influence of the material properties.

4. The method of claim 3, wherein the carrier liquid contains alloy elements selected from the group consisting of Cr, W, Co, Mo, Si and C, and wherein the alloy elements alloy up the applied steel melt by melting.

5. The method of claim 3, wherein the carrier liquid contains oxides, nitrides or borides with a higher melting point than steel, which after application of the melt remain on the forming steel strip essentially as securely adhering coating.

6. The method of claim 1, further comprising controlling a degree of melting of the dried coating mass by controlling a heat exchange between the melt and the dried coating mass via at least one of an additional cooling of the cast band, a thickness of the coating mass applied to the cast band and a casting speed of the melt.

7. The method of claim 1, wherein a portion of the dried coating mass which was not melted after application of the melt remains as coating on the surface of said side of the cast band or on a surface of the steel strip resulting from the casting.

8. The method of claim 1, further comprising controlling a cooling speed of the melt by controlling a heat transmission between the cast band and the steel melt via a thickness of the applied coating mass.

9. The method of claim 1, wherein the coating mass is applied onto the cast band in liquid or paste-like form.

10. The method of claim 1, wherein the thickness of the coating is adjusted by mechanical stripping and/or by grit blasting of the applied coating mass.

11. The method of claim 1, wherein the thickness of the coating mass is adjusted via its viscosity.

12. The method of claim 1, wherein the coating mass is applied from a bottom side of the cast band.

13. The method of claim 12, wherein the coating mass is applied by means of a container that is filled with the coating mass and an applicator roll with an elastic surface.

14. The method of claim 13, wherein a thickness of the applied coating mass is adjusted via a pressing force of the applicator roll onto the cast band.

15. The method of claim 13, wherein a thickness of the applied coating mass is adjusted via a rotational speed of the applicator roll and/or via the speed of the steel melt.

16. The method of claim 13, wherein a thickness of the applied coating mass is adjusted via a surface texture of the elastic surface of the applicator roll.

17. The method of claim 1, wherein the coating mass is applied mechanically.

* * * * *